US008887942B2

(12) United States Patent
Miksovsky et al.

(10) Patent No.: US 8,887,942 B2
(45) Date of Patent: Nov. 18, 2014

(54) COLLAPSIBLE CUP ASSEMBLY WITH A CONTAINER LID

(71) Applicant: Humangear, Inc., San Francisco, CA (US)

(72) Inventors: Christopher A. Miksovsky, San Francisco, CA (US); Clint N. Slone, San Francisco, CA (US)

(73) Assignee: Humangear, Inc., San Francisco, CA (US)

( * ) Notice: Subject to any disclaimer, the term of this patent is extended or adjusted under 35 U.S.C. 154(b) by 0 days.

(21) Appl. No.: 13/737,422

(22) Filed: Jan. 9, 2013

(65) Prior Publication Data

US 2013/0181000 A1 Jul. 18, 2013

Related U.S. Application Data

(60) Provisional application No. 61/587,835, filed on Jan. 18, 2012.

(51) Int. Cl.

| | |
|---|---|
| ***B65D 25/04*** | (2006.01) |
| ***B65D 1/24*** | (2006.01) |
| ***B65D 21/02*** | (2006.01) |
| ***B65D 43/03*** | (2006.01) |
| ***B65D 51/18*** | (2006.01) |
| ***A47G 19/22*** | (2006.01) |
| ***B65D 1/40*** | (2006.01) |
| ***A45F 3/20*** | (2006.01) |

(52) U.S. Cl.

CPC ... *B65D 1/40* (2013.01); *A45F 3/20* (2013.01); *A45F 2003/205* (2013.01); *Y10S 215/90* (2013.01)

USPC ..... 220/521; 220/666; 220/522; 220/23.87; 220/23.88; 206/218; 206/219; 215/900; 215/227; 426/111; 426/120

(58) Field of Classification Search

USPC ..... 220/521, 666, 522, 796, 801, 802, 780, 220/789, 790, 23.87, 23.88, 914, 202, 231, 220/303, 367.1; 206/216, 219, 221, 218; 215/900, 227; 426/11

See application file for complete search history.

(56) References Cited

U.S. PATENT DOCUMENTS

| | | | |
|---|---|---|---|
| 640,418 | A | 1/1900 | Royer |
| 879,753 | A | 2/1908 | Eckert |

(Continued)

OTHER PUBLICATIONS

Travel Cup Pill Box, http://www.sz-wholesale.com/p/Travel-Cup-and-Pill-Box/Travel-Cup-Pill-Box-371437.html, Aug. 17, 2011.

*Primary Examiner* — Fenn Mathew
*Assistant Examiner* — Jennifer Castriotta
(74) *Attorney, Agent, or Firm* — Beyer Law Group LLP

(57) ABSTRACT

A collapsible drinking cup assembly having a plurality of annular ring segments each flexibly coupled together, end-to-end. An upper drinking lip segment of the ring segments includes an interior and exterior sidewall such that the drinking lip segment tapers inwardly from a lower base portion to an annular upper distal edge thereof. A support floor of the cup apparatus includes an annular bottom flange extending radially beyond an exterior wall of the bottom ring segment. Atop lid member extends over an opening into the cup apparatus, and includes a pair of opposed, inner and outer contact walls that collectively define an annular receiving groove therebetween. The cup apparatus can be expanded from a collapsed position to an expanded position when both the annular bottom flange and the lid member are radially gripped and axially pulled apart longitudinally thereof before separation of the lid member from the drinking lip segment.

15 Claims, 16 Drawing Sheets

(56) References Cited

U.S. PATENT DOCUMENTS

| | | | | | |
|---|---|---|---|---|---|
| 1,048,935 | A | | 12/1912 | Brady | |
| 1,093,873 | A | | 4/1914 | Mitchell | |
| 1,606,811 | A | * | 11/1926 | Schilke | 206/8 |
| 2,211,326 | A | | 8/1940 | Gillice | |
| 2,802,590 | A | | 8/1957 | Tupper | |
| 2,880,902 | A | | 4/1959 | Owsen | |
| 3,285,459 | A | | 11/1966 | Gahm | |
| 3,434,587 | A | | 3/1969 | Ciampa | |
| D219,474 | S | | 12/1970 | Gahm | |
| D220,204 | S | | 3/1971 | Gahm | |
| 4,875,576 | A | | 10/1989 | Torgrimson et al. | |
| D309,116 | S | | 7/1990 | Marshall | |
| 4,940,138 | A | | 7/1990 | Hornstein | |
| D347,359 | S | | 5/1994 | Robbins, III | |
| 5,384,138 | A | * | 1/1995 | Robbins et al. | 426/111 |
| 5,415,309 | A | | 5/1995 | Wang | |
| 5,439,128 | A | * | 8/1995 | Fishman | 220/8 |
| D374,401 | S | | 10/1996 | Behnen, Jr. | |
| 5,632,406 | A | * | 5/1997 | Robbins, III | 220/666 |
| 5,862,932 | A | | 1/1999 | Walsh et al. | |
| 6,021,903 | A | * | 2/2000 | Hanson | 206/541 |
| D424,750 | S | | 5/2000 | Zalzal | |
| 6,102,242 | A | * | 8/2000 | Jansen | 220/619 |
| D483,225 | S | | 12/2003 | Gain | |
| 6,736,285 | B2 | | 5/2004 | Stewart-Stand | |
| D515,928 | S | | 2/2006 | Pace | |
| 7,055,709 | B1 | | 6/2006 | Esau | |
| D544,303 | S | | 6/2007 | Strepkoff | |
| D550,036 | S | | 9/2007 | Holcomb et al. | |
| D556,509 | S | | 12/2007 | Bonini | |
| 7,614,513 | B2 | * | 11/2009 | Anderson | 215/10 |
| D664,003 | S | | 7/2012 | Nagoya | |
| 2004/0035867 | A1 | * | 2/2004 | Schultz et al. | 220/212 |
| 2009/0101654 | A1 | | 4/2009 | Brashear | |
| 2010/0147015 | A1 | * | 6/2010 | Vanderberg et al. | 62/457.7 |

* cited by examiner

COLLAPSIBLE CUP ASSEMBLY WITH A CONTAINER LID

CROSS-REFERENCE TO RELATED APPLICATIONS

This application claims priority under 35 U.S.C. §119(e) from U.S. Provisional Patent Application No. 61/587,835, filed Jan. 18, 2012, entitled "COLLAPSIBLE CUP ASSEMBLY WITH CONTAINER LID", naming Miksovsky et al. as inventors, and which is incorporated herein by reference in its entirety and for all purposes.

FIELD OF THE INVENTION

The present invention relates to collapsible cups with mountable lids, and more particularly, with collapsible drinking cups with mountable lids having integrated container inventors, and which is incorporated herein by reference in its entirety and for all purposes.

BACKGROUND OF THE INVENTION

The present invention relates to collapsible cups with mountable lids, and more particularly, with collapsible drinking cups with mountable lids having integrated container.

Current collapsible cups are typically made from concentric, tapered rings that nest into one another. These rings are generally made from plastic or metal. The pressing action of one ring into an adjacent one creates a temporary seal. However, due to imperfections in the rings, or through wear over time, gaps can form between the rings leading to leakage.

Another deficiency of these traditional collapsible cups is that the rings can sometimes be accidentally separated through the pulling action to achieve the expanded form. The separation requires the user to reassemble the removed ring(s) which can be difficult. Finally, the concentric ring cups create a cup form with numerous internal edges and crevices (between the rings). These edges and crevices can be difficult to clean and can harbor dirt and bacteria.

Some companies have made collapsible cups from elastomers such as silicone. These cups are constructed of a single piece of elastomer and remedy some of the above-mentioned problems related to sealing, separation and cleaning. However, these elastomeric collapsible cups do not feature mountable lids or mountable lids with integrated containers.

Accordingly, it is desirable to provide a collapsible cup assembly that includes a container mounted lid, and that facilitates easier expansion and collapse of the cup assembly.

SUMMARY OF THE INVENTION

The present invention provides a collapsible drinking cup assembly including a flexible cup apparatus manually movable between a collapsed position and an expanded position. The cup apparatus includes a plurality of annular ring segments each flexibly coupled together, end-to-end, at a flexible, annular fold interface. These ring segments are sequentially sized and dimensioned such that each respective adjacent lower ring segment is concentrically nested within each respective adjacent upper ring segment, when in the collapsed position. The plurality of annular ring segments include an upper drinking lip segment having an interior sidewall and an exterior sidewall such that the drinking lip segment tapers inwardly from a lower base portion to an annular upper distal edge thereof. At least one of the interior sidewall and/or the exterior side wall of the drinking lip segment are concave. The cup apparatus further includes a support floor extending over a bottom ring segment of the plurality of annular ring segments. The support floor includes an annular bottom flange extending radially beyond an exterior wall of the bottom ring segment. The drinking cup assembly further includes a relatively rigid top lid member having a top lid portion formed and dimensioned to extend over an opening into the cup apparatus, the opening of which is defined by the upper distal edge of the drinking lip segment. The top lid member includes a pair of opposed, inner and outer contact walls downstanding from the top lid portion that collectively define an annular receiving groove therebetween. This receiving groove is formed and dimensioned for friction-fit receipt of the drinking lip segment therein such that the cup apparatus can be expanded from the collapsed position to the expanded position when both the annular bottom flange and the lid member are radially gripped and axially pulled apart longitudinally thereof before separation of the lid member from the drinking lip segment.

Accordingly, when gripping the lid member on its sides, while mounted to the cup apparatus, in one hand, and gripping the bottom ring segment, on the other hand, and pulling apart in the axial direction thereof, the cup apparatus can be expanded from the collapsed position to the expanded position generally prior to separation of the lid member from the upper cup drinking lip segment. Moreover, the lid member itself is relatively rigid and includes an integrated container for pills, change or the like. Thus, when lid member/integrated container assembly is mounted to the cup apparatus, this assembly provides a stable platform to axially collapse the flexible cup apparatus around.

In one specific embodiment, the exterior sidewall of the drinking lip segment is concave. Further, the lower base portion of the drinking lip segment includes an upward facing annular shoulder portion formed and dimensioned to seat against a lower annular edge of the exterior contact wall of the top lid member when the drinking lip segment is fully received within the receiving groove, forming an air-tight seal.

In another configuration, the top lid member defines one or more communication apertures extending therethrough.

Still another embodiment includes the annular ring segments with alternating cylindrical ring segments and conical ring segments when oriented in the expanded position.

Another specific embodiment provides the top lid member with an annular, central container wall downwardly depending from the top lid portion, defining a primary container cavity. The cup assembly further includes a relatively rigid container cover member having a container cover portion formed and dimensioned to extend over an opening into the primary container cavity, the opening of which is defined by a lower distal edge of the central container wall. The container cover member further includes an annular cover contact wall upstanding from the container cover portion, and formed and dimensioned for friction-fit association with the central container wall for mounting thereto.

In yet another configuration, one of an outer facing surface of the central container wall and an inner facing surface of the cover contact wall defines an annular ledge portion. Furthermore, the other of the inner facing surface of the cover contact wall and the outer facing surface of the central container wall defines at least one retaining nub. This retaining nub is formed and dimensioned to cooperate with the annular ledge portion for friction-fit engagement therebetween.

One specific configuration provides a relatively rigid intermediary cover device having an intermediary cover portion formed and dimensioned to extend over the opening into the primary container cavity. The intermediary cover device includes an annular upper contact wall upstanding from the intermediary cover portion and which is formed and dimensioned for friction-fit association with the central container wall for mounting of the intermediary cover device thereto. The intermediary cover device further includes an annular lower contact wall downwardly depending from the intermediary cover portion and defining a secondary container cavity therein The lower contact wall is formed and dimensioned for friction-fit association with the annular cover contact wall of the container cover portion for mounting thereto, enclosing the secondary container cavity.

In another aspect of the present invention, a collapsible drinking cup assembly is provided which includes a flexible cup apparatus manually movable along a longitudinal axis thereof between a collapsed position and an expanded position. The cup apparatus includes a plurality of annular ring segments each flexibly coupled together, end-to-end, at a flexible, annular fold interface. The ring segment is sequentially sized and dimensioned such that each respective adjacent lower ring segment is concentrically nested within each respective adjacent upper ring segment, when in the collapsed position. The plurality of annular drinking lip segment includes an upper drinking lip segment and a bottom ring segment. The upper ring includes an annular upper distal edge thereof defining an opening into the cup apparatus, and the bottom ring segment includes a support floor extending over a bottom portion thereof. In the collapsed position, the cup apparatus has a collapsed height, along the longitudinal axis thereof, extending from the upper distal edge to an interior bottom surface of the support floor. The drinking cup assembly further includes a relatively rigid top lid member having a top lid portion formed and dimensioned to extend over the opening into the cup apparatus when removably mounted to the cup apparatus, in a closed condition. The top lid member includes an annular, central container wall downwardly depending from the top lid portion, defining a primary container cavity. The cup assembly also includes a relatively rigid container cover member having a container cover portion formed and dimensioned to extend over an opening into the primary container cavity, the opening of which is defined by a lower distal edge of the central container wall. The container cover further includes an annular cover contact wall upstanding from the container cover portion. The container cover is formed and dimensioned for friction-fit association with the central container wall for mounting thereto. Finally, the top lid member and the container cover member are formed and dimensioned such that when the container cover member is removably mounted to the top lid member. A longitudinal cover height extending from a top surface of the top lid member to a bottom surface of the container cover member is generally the same as the collapsed height of the cup apparatus when the cup apparatus and the top lid member are in the closed condition.

In one specific embodiment, a relatively rigid intermediary cover device is provided having an intermediary cover portion formed and dimensioned to extend over an opening into the primary container cavity, the opening of which is defined by a lower distal edge of the central container wall. The intermediary cover device includes an annular upper contact wall upstanding from the intermediary cover portion. The upper contact wall is formed and dimensioned for friction-fit association with the central container wall for mounting of the intermediary cover device thereto. The intermediary cover device further includes an annular lower contact wall downwardly depending from the intermediary cover portion which defines an opening into a secondary container cavity therein. In this configuration, the relatively rigid container cover member is friction-fit associated with the lower contact wall for mounting thereto. The top lid member, the intermediary cover device are formed and dimensioned such that when the intermediary cover device is removably mounted to the top lid member, and the container cover member is removably mounted to the intermediary cover device, a collective longitudinal cover height is defined. This cover height extends from a top surface of the top lid member to an exterior bottom surface of the container cover member, and is generally the same as the collapsed height of the cup apparatus when the cup apparatus and the top lid member are in the closed condition.

BRIEF DESCRIPTION OF THE DRAWINGS

The assembly of the present invention has other objects and features of advantage which will be more readily apparent from the following description of the best mode of carrying out the invention and the appended claims, when taken in conjunction with the accompanying drawings, in which:

DETAILED DESCRIPTION OF THE INVENTION

Figure 1:
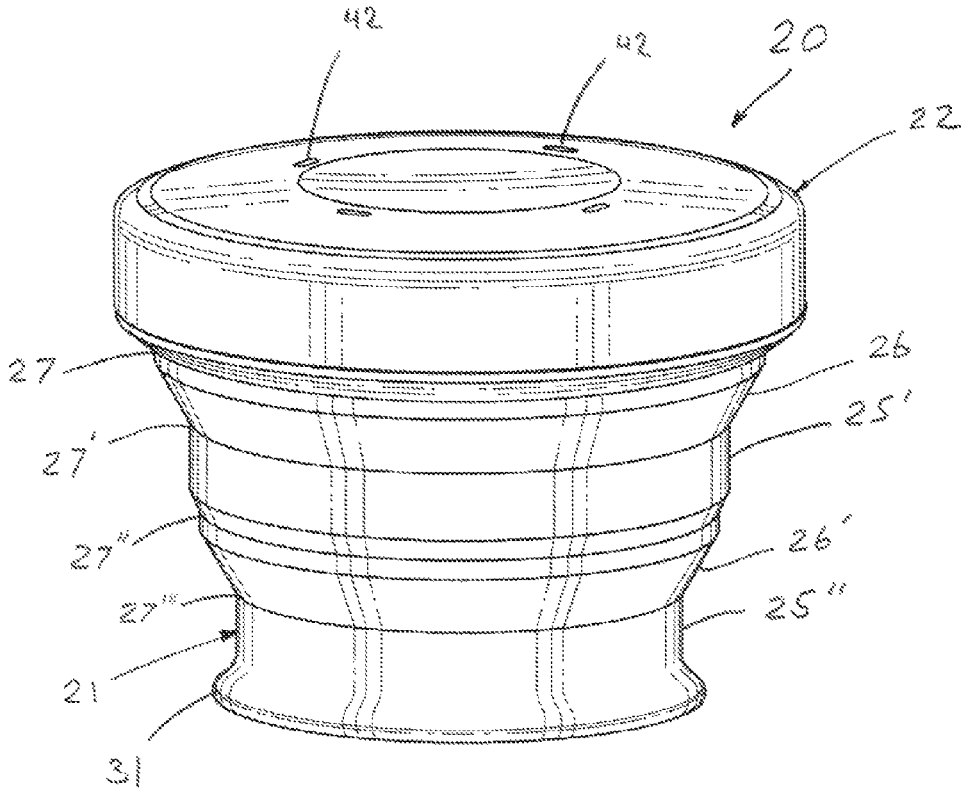
FIG. 1 is a top perspective view of a collapsible cup assembly constructed in accordance with the present invention, illustrated in an expanded position.

While the present invention will be described with reference to a few specific embodiments, the description is illustrative of the invention and is not to be construed as limiting the invention. Various modifications to the present invention can be made to the preferred embodiments by those skilled in the art without departing from the true spirit and scope of the invention as defined by the appended claims. It will be noted here that for a better understanding, like components are designated by like reference numerals throughout the various figures.

Figure 3:
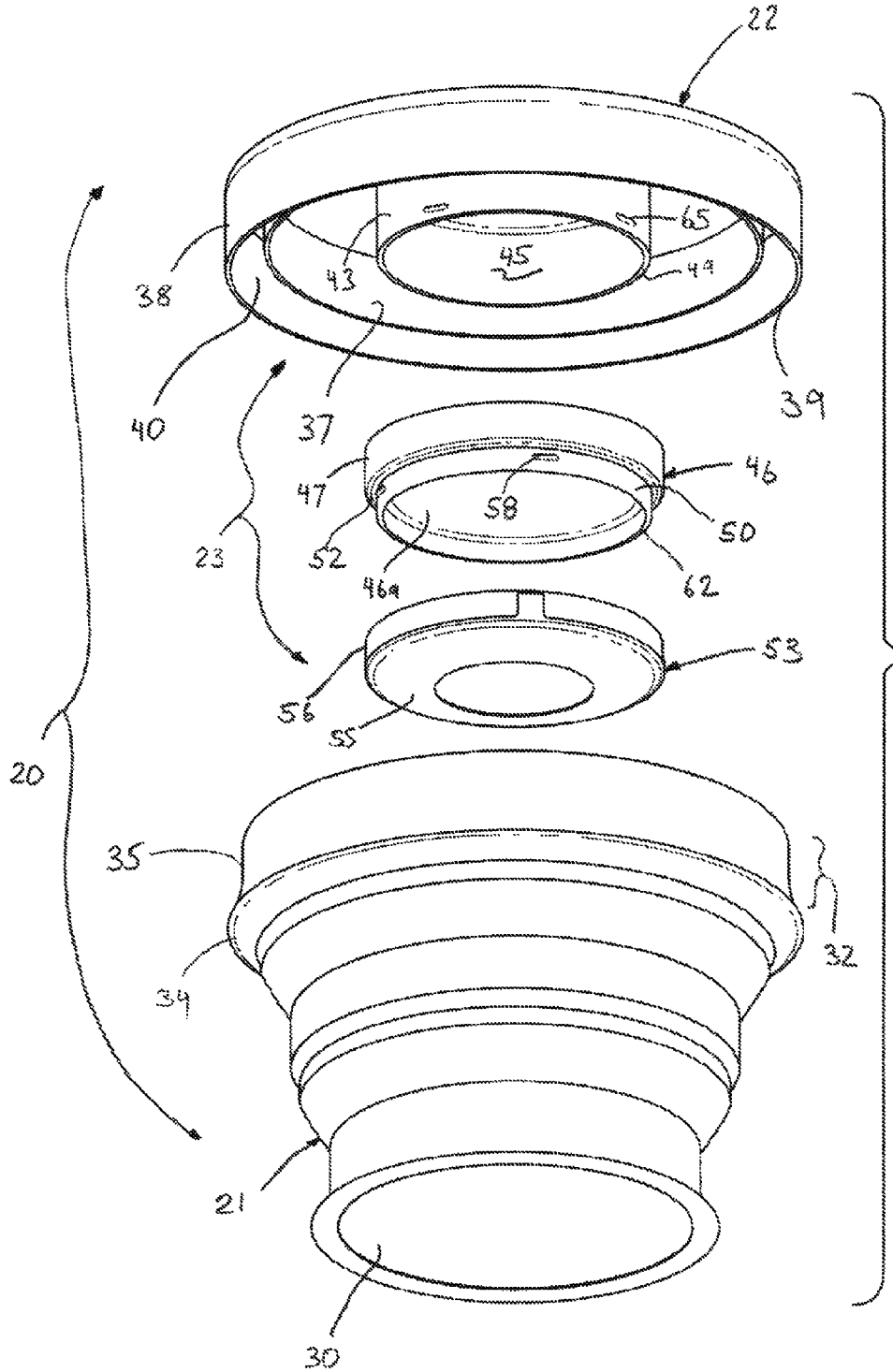
FIG. 3 is an exploded, bottom perspective view of the collapsible cup assembly of FIG. 2.
Figure 4:
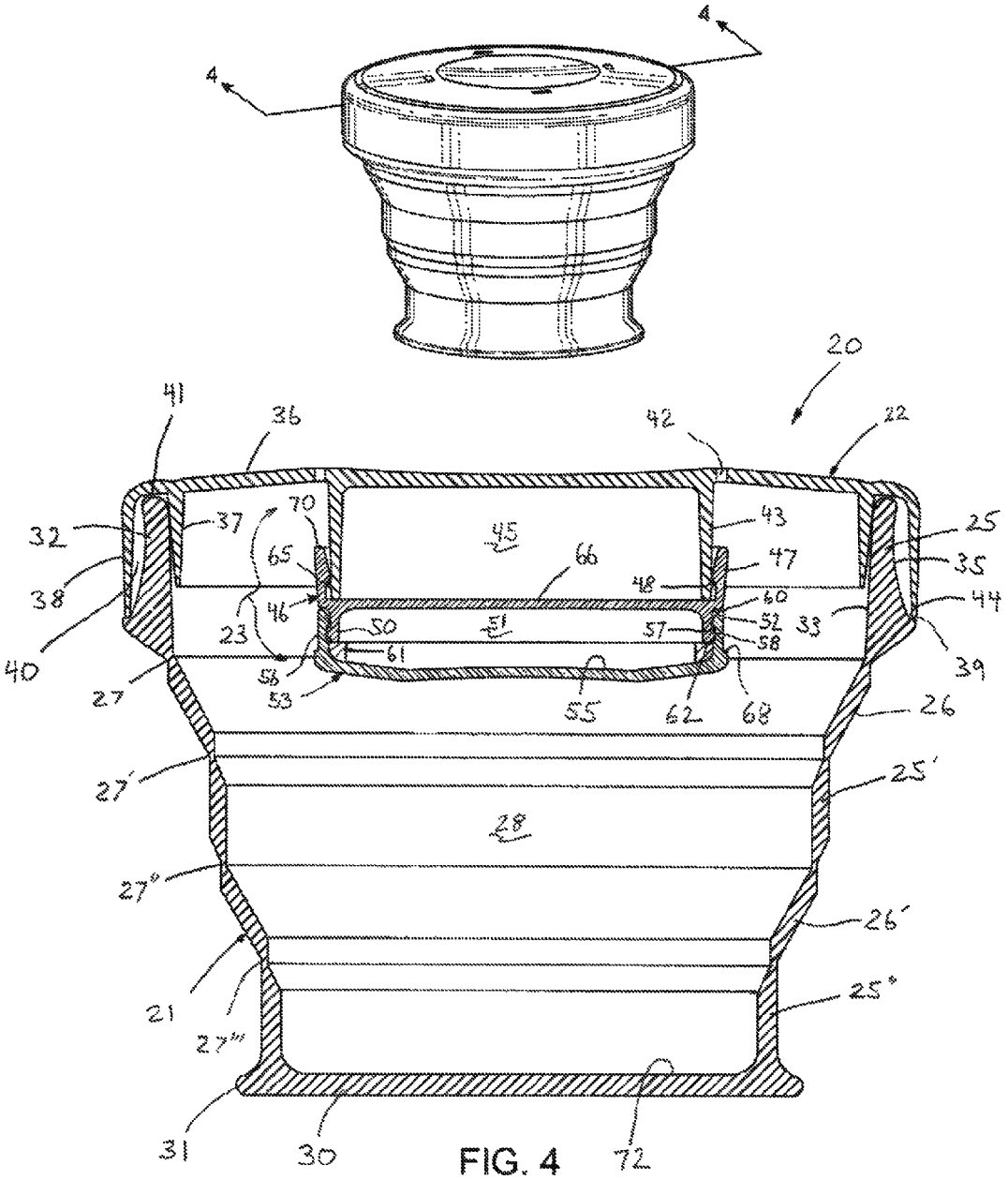
FIG. 4 is an enlarged, side elevation view, in cross-section, of the collapsible cup assembly of FIG. 1.
Figure 5:
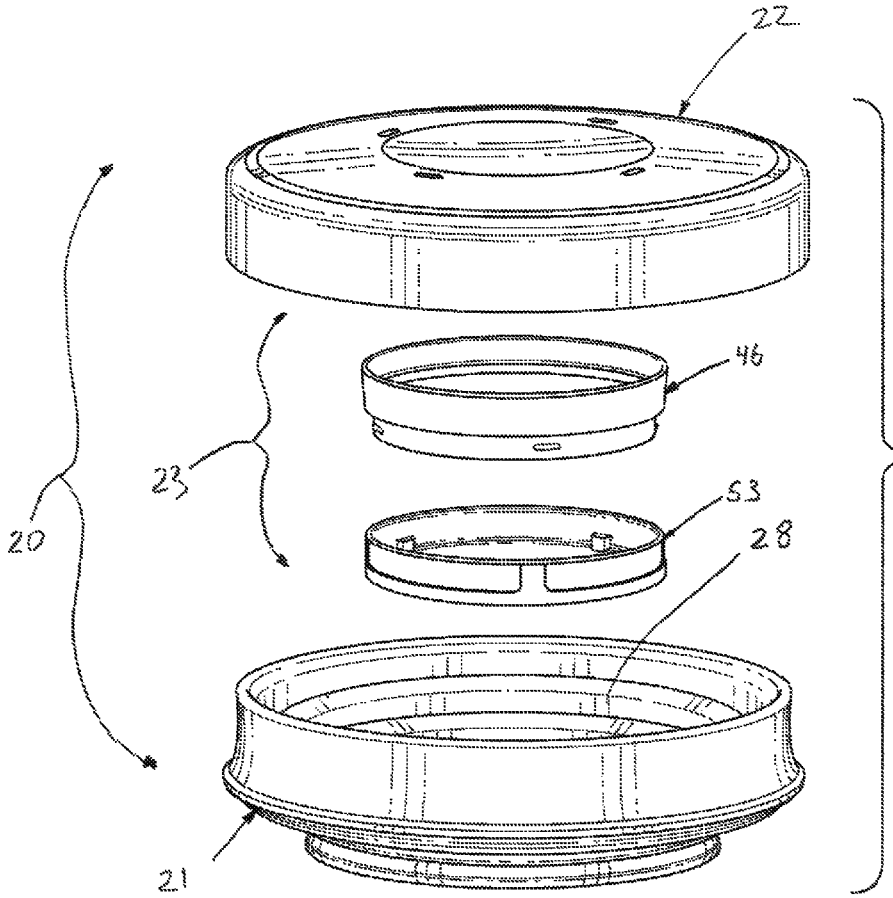
FIG. 5 is an exploded, top perspective view of the collapsible cup assembly of FIG. 1, illustrated in a collapsed position.
Figure 6:
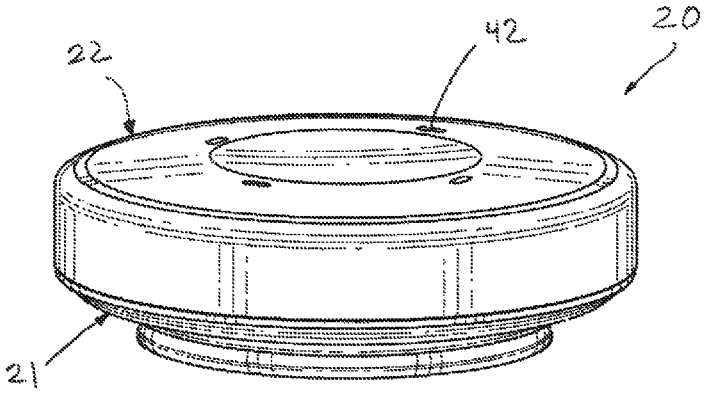
FIG. 6 is atop perspective view of the collapsible cup assembly of FIG. 1, illustrated in the collapsed position.
Figure 7:
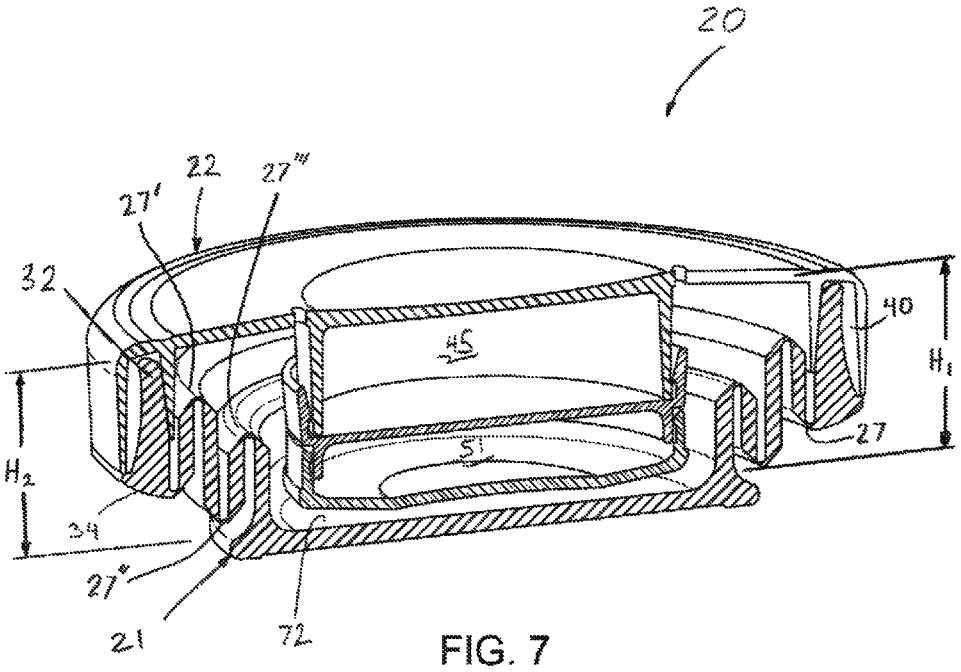
FIG. 7 is a top perspective view, in cross-section, of the collapsible cup assembly of FIG. 6.

Turning now to FIGS. 1-5, a collapsible drinking cup assembly, generally designated 20, is provided having a flexible cup apparatus 21 with a mountable, relatively rigid lid or top lid member 22. In specific embodiments, the lid member 22 incorporates its own rigid container apparatus 23 integrated into the underside thereof. The cup apparatus 21 is manually movable between an operational expanded position (FIGS. 1-4 and 8) and a stored collapsed position (FIGS. 5-7). The cup apparatus 21 includes a plurality of annular ring segments (e.g., 25, 25', 25", 26, 26') each flexibly and integrally coupled together, end-to-end, at a flexible, annular fold interface (e.g., 27, 27', 27', 27"). These ring segments are sequentially sized and dimensioned such that each respective adjacent lower ring segment (e.g., 26', 25"; or 25', 26', etc.) is concentrically nested within each respective adjacent upper ring segment, when in the collapsed position (FIG. 7). The plurality of annular ring segments include an upper drinking lip segment 32 having an interior sidewall 33 and an exterior sidewall 35 such that the drinking lip segment tapers inwardly from a lower base portion 34 to an annular upper distal edge 41 thereof. At least one of the interior sidewall 33 and/or the exterior sidewall 35 of the drinking lip segment 32 is concave. The cup apparatus 21 further includes a support floor 30 extending over a bottom ring segment 25" of the plurality of annular ring segments. The support floor 30 includes an annular bottom flange 31 extending radially beyond an exterior wall of the bottom ring segment 25".

As mentioned above, the drinking cup assembly 20 includes the relatively rigid top lid member 22 having a top lid portion 36 formed and dimensioned to extend over an opening into the cup cavity 28 of the cup apparatus. This opening is defined by the upper distal edge 41 and the interior sidewall 33 of the drinking lip segment 32. The top lid member 22 includes a pair of opposed, inner and outer contact walls 37, 38 downstanding from the top lid portion 36 that collectively define an annular receiving groove 40 therebetween. This receiving groove 40 is formed and dimensioned for friction-fit receipt of the drinking lip segment 32 therein such that the cup apparatus 21 can be expanded from the collapsed position (FIGS. 5-7) to the expanded position (FIGS. 1-4 and 8) when both the annular bottom flange 31 and the lid member 22 are radially gripped and axially pulled apart longitudinally thereof before separation of the lid member from the drinking lip segment. It will be appreciated, of course, that the cup apparatus 21 can also be expanded from the collapsed position to the expanded position when both the annular bottom flange 31 and the lower base portion 34 are radially gripped and axially pulled apart longitudinally thereof as well.

Accordingly, a portable travel cup is provided that is very flexible and expandable. In the expanded position, the cup apparatus functions as a drinking cup. In the collapsed position, the cup assembly 20 is significantly more portable and pocketable. Due in part to relationship between the rigid contact walls of the lid member and the flexible components of the cup apparatus, not only does the friction-fit mounting of the lid member to the drinking lip segment help retain the lid member to the drinking lip segment during axial separation therebetween, but a small low pressure vacuum is formed for a slight suction type mount that effectively functions to retain the cover onto the cup. Hence, when gripping the lid member on its sides, while mounted to the cup apparatus, in one hand, and gripping the bottom ring segment, on the other hand, and pulling apart in the axial direction thereof, the cup apparatus can be expanded from the collapsed position to the expanded position generally prior to separation of the lid member from the upper cup drinking lip segment. Moreover, the lid member itself is relatively rigid and includes an integrated container for pills, change or the like. Thus, when lid member/integrated container assembly is mounted to the cup apparatus, this assembly provides a stable platform to axially collapse the flexible cup apparatus around.

The cup apparatus 21 is preferably composed of a flexible silicone rubber material with a shore hardness of about 50 A~70 A, and is primarily comprised of the annular ring segments (e.g., 25, 25', 25", 26, 26') and the flexible, annular fold interface (e.g., 27, 27', 27', 27'"). It will be appreciated, however, that more or less ring segments can be provided. Preferably, however, the annular ring segments include a plurality of cylindrical-shaped rings segments 25, 25' and 25" and a plurality of conical-shaped segments 26, 26' coupled together, alternately, when oriented in the expanded position. Briefly, it will be appreciated when the cup apparatus is collapsed to the collapsed position of FIG. 7, the conical ring segments 26, 26' are reoriented into cylindrical-shaped ring segments.

Figure 8:
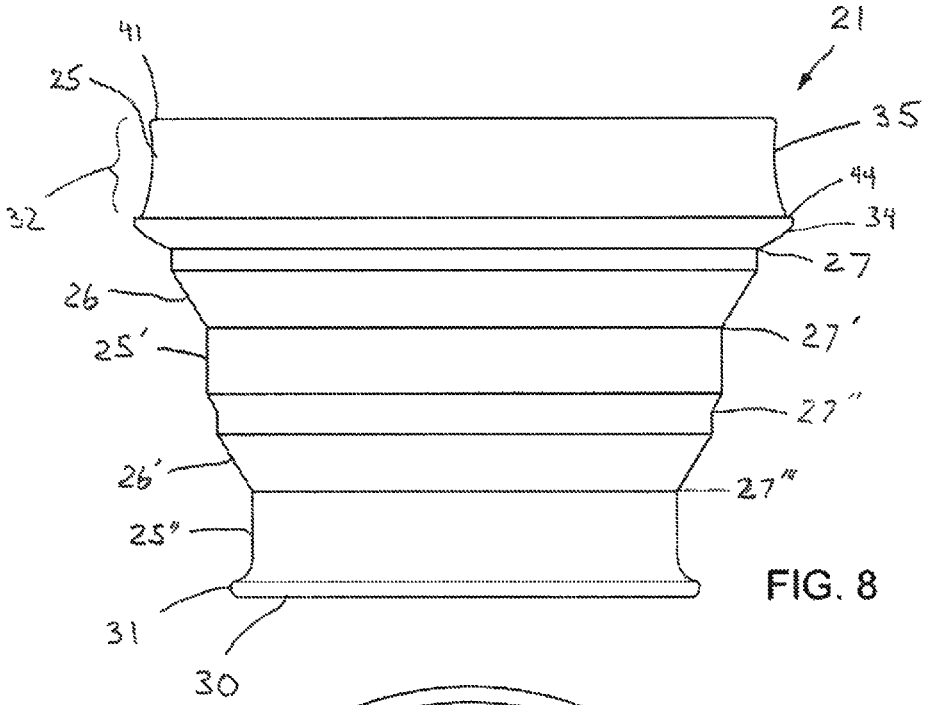
FIG. 8 is a side elevation view of a cup apparatus of the collapsible cup assembly of FIG. 1.
Figure 9:
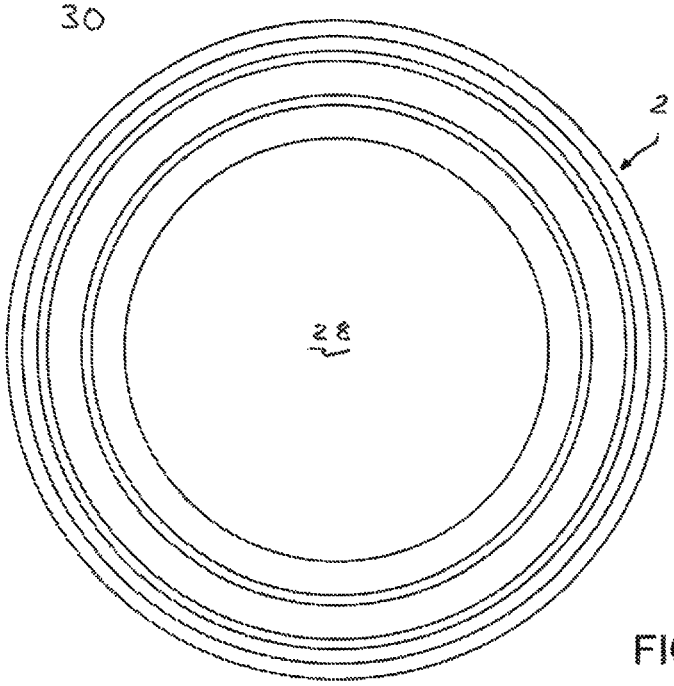
FIG. 9 is a top plan view of the cup apparatus of FIG. 8.
Figure 10:
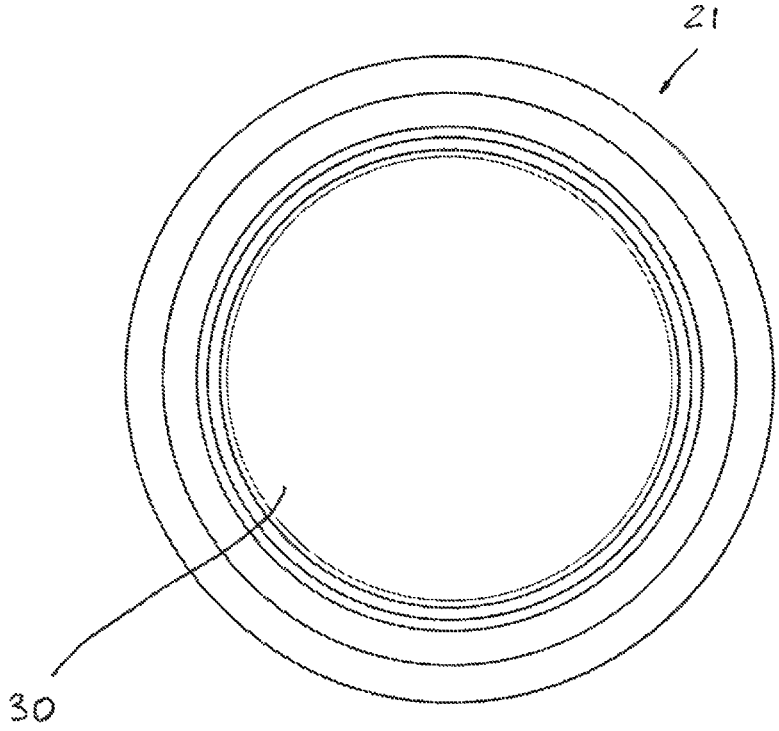
FIG. 10 is a bottom top plan view of the cup apparatus of FIG. 8.
Figure 11:
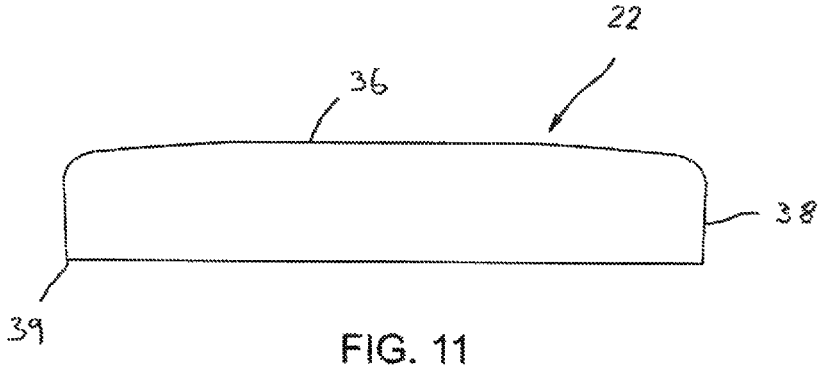
FIG. 11 is a side elevation view of a top lid member of the collapsible cup assembly of FIG. 1.
Figure 12:
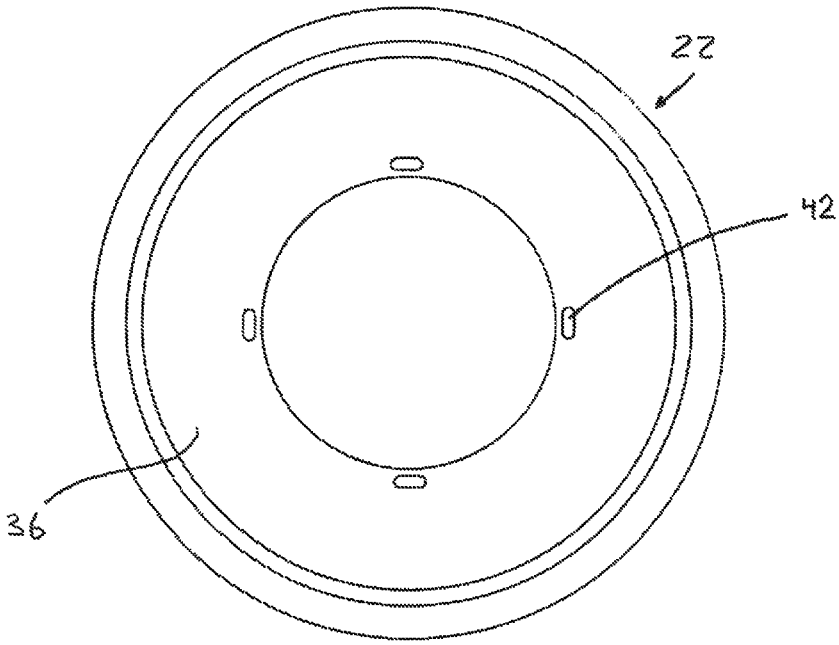
FIG. 12 is a top plan view of the top lid member of FIG. 11.

As best viewed in FIGS. 4, 7 and 8, the cylindrical ring segments 25, 25' and 25", as well as the conical ring segments 26, 26' are progressively smaller in diameter and alternately oriented such that they fit concentrically or nested within one another, when in the collapsed position (FIG. 5-7). The segments are also similar in height such that they are efficiently concentrically stored, when collapsed, and maximize cup height, when expanded.

The conical shaped ring segments 26, 26' are oriented to taper outwardly and upwardly such that the diameter of the respective lower portions thereof generally correspond to the diameter of the next adjacent, smaller diameter ring segment upon which the respective lower portion is integrally mounted to. In a similar manner, the diameter of the respective upper portions of the conical shaped segments generally correspond to the diameter of the next adjacent, larger diameter ring segment upon which the respective upper portion is integrally mounted to.

At each interface between the annular rings segments 25, 25' and 25" and the conical shaped segments 26, 26', their respective walls thereof thin or taper inwardly, and are integrally formed or mounted to one another at a fold interface 27, 27', 27" and 27'". Collectively, when the cup apparatus is oriented in the expanded position, a cup cavity 28 is formed for use.

Since the interface wall thickness at the fold interfaces 27, 27', 27" and 27'" is significantly thinner than the corresponding thickness of the respective walls of the annular rings segments 25, 25' and 25" and the conical shaped segments 26, 26', upon axial compression of the expanded silicon cup apparatus 21 from the expanded position (FIGS. 1-4 and 8) to the collapsed position (FIGS. 5-7), the ring segments are easily creased at these fold interfaces in bi-stable folding and unfolding manner.

Figure 20:
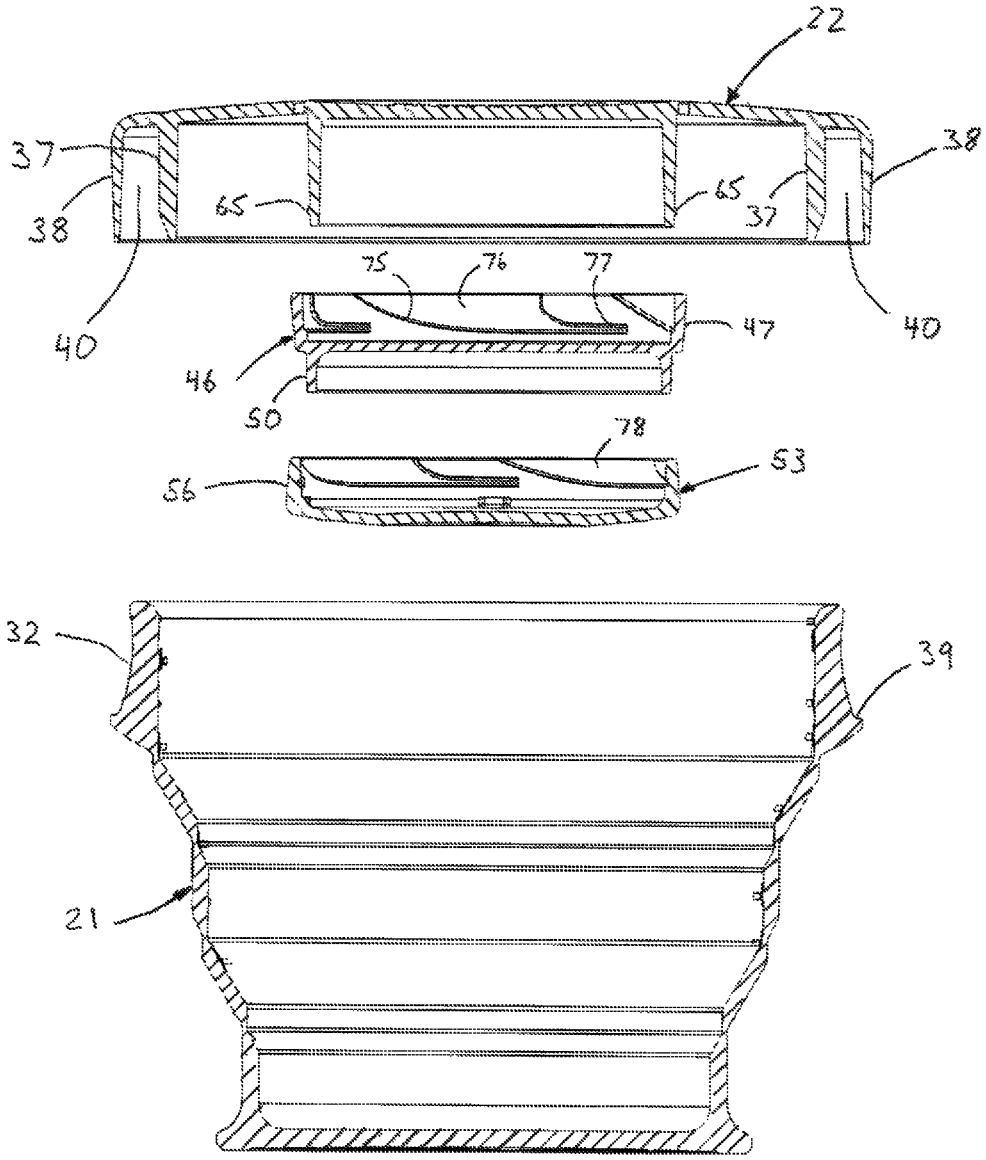
FIG. 20 is an exploded, side elevation view, in cross-section, of the collapsible cup assembly of FIG. 1.

Referring now to FIGS. 4 and 20, the ring segments are disposed in alternating vertical ring segments 25, 25' and 25" and angled conical shaped segments 26, 26'. When in the collapsed position (FIGS. 5-7), the vertical ring segments 25, 25' and 25" remain approximately vertical when collapsed. The angled conical shaped segments 26, 26' differ, however, when being folded from the expanded position to the collapsed position. The outer circumferential wall of the conical shaped segments 26, 26' will be stretched, while the inner circumferential walls thereof will be compressed to allow inversion (resulting in a collapsed cup). The process of collapsing has a peak stretch/compression point in between the two main states. This is what makes the cup bi-stable and tend to remain in the less stressed fully expended or the fully compressed state.

Moreover, it has been determined that by providing alternating vertical ring segments 25, 25', 25" and nearly vertical or steeply angled conical ring segments 26, 26', the cup apparatus will have a very strong resistance to collapsing since the steep angled walls must stretch/compress significantly to invert, making for a highly bi-stable cup. It has also been determined that the ideal wall angle between the alternating vertical ring segments 25, 25', 25" (no undercuts for easy molding) and the nearly vertical or steeply angled conical ring segments 26, 26' is in the range of about 25 degrees to about 35 degrees, and preferably approximately 30 degrees from the vertical. Having too steep of alternating conical ring segments 26, 26', relative to the vertical ring segments 25, 25', 25" of around 20 degrees or less has been found to be too difficult and unreliable to collapse, while angles greater than about 35 degrees have resulted in a more "springy" cup, less bistable, and less compact cup assemblies when collapsed.

Briefly, it will be appreciated that while the cup apparatus is shown and described as having three annular ring segments 25, 25' and 25" and two conical shaped ring segments 26, 26', more or less segments can be employed. Moreover, it will be understood that other flexible inert material can be used such as thermo-plastic-elastomers (TPEs), thermo-plastic urethanes (TPUs), and other commercially available elastomers can be used.

As best shown in FIGS. 4 and 8, the bottom ring segment 25" incorporates the support floor 30 that functions as the floor of the cup cavity 28, as well as providing a support base to support the cup apparatus in the upright position. To provide further stability, an annular bottom flange 31 flares radially outwardly to increase the diameter of the support base. This bottom flange 31, thus, provides the dual function of increasing cup stability at the base, as well as, facilitating gripping at the edges of the support base while the cup apparatus is being axially expanded from the collapsed position (FIGS. 5-7) toward the expanded position (FIGS. 1-4 and 8), as will be described.

The height of the bottom ring segment 25" is sized, height wise, such that in the collapsed position, the bottom flange 31 and the support floor 30 extends below the other portions of the cup apparatus 21. As shown in FIG. 7, this arrangement facilitates expansive gripping thereof.

A top ring segment 25, which is also of the largest in diameter, provides a cup drinking lip segment 32 for a user. The interior sidewall 33 thereof is generally vertical, while the exterior sidewall 35 is curvilinear or concave-shaped. FIG. 4 best illustrates that, commencing from an annular upper distal edge 41 of the cup apparatus 21, which together with the interior sidewall 33 define an opening into the container cavity 28, the exterior sidewall 35 initially tapers inwardly at a gentle slope before tapering radially outwardly at a more pronounced curvature to a lower base portion 34. Collectively, this forms a flexible, upwardly facing concave curvature.

The lower base portion 34 of the drinking lip segment 32 defines an upwardly facing annular shoulder portion 44 extending all the way around the cup apparatus 21. This shoulder portion 44 primarily functions as a stop device to cease the downward motion of the lid onto the lip. However, this shoulder portion 44 also cooperates with the lid member 22 to seal and securely retain the same to the cup apparatus, as will be described in greater detail below.

Figure 13:
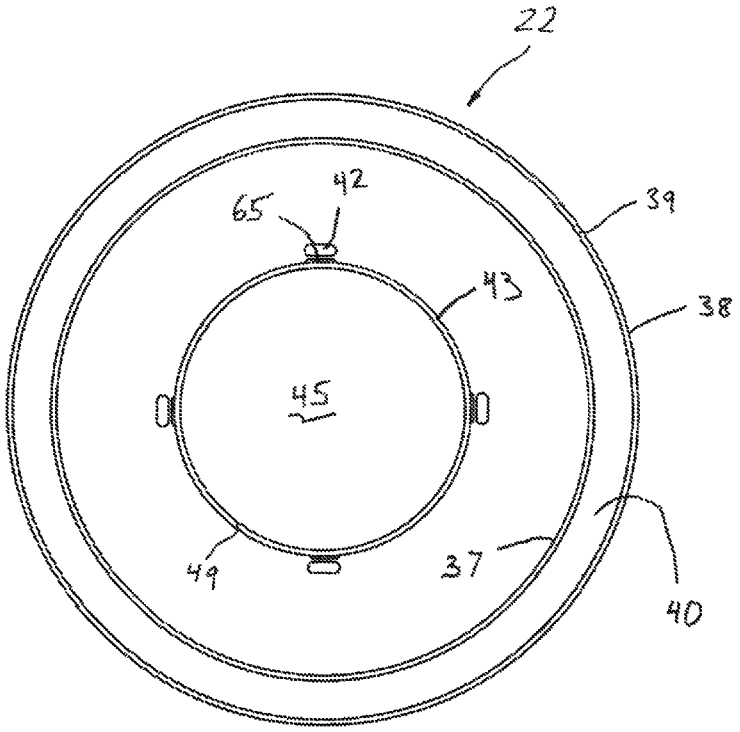
FIG. 13 is a bottom plan view of the top lid member of FIG. 11.
Figure 14:
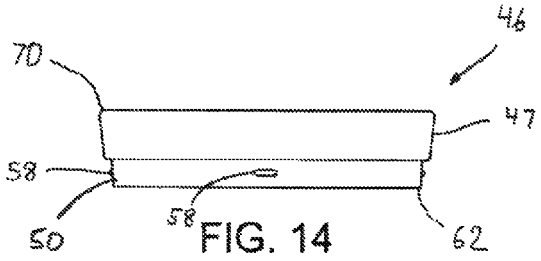
FIG. 14 is a side elevation view of an intermediary cover device of a container apparatus of the collapsible cup assembly of FIG. 1.
Figure 15:
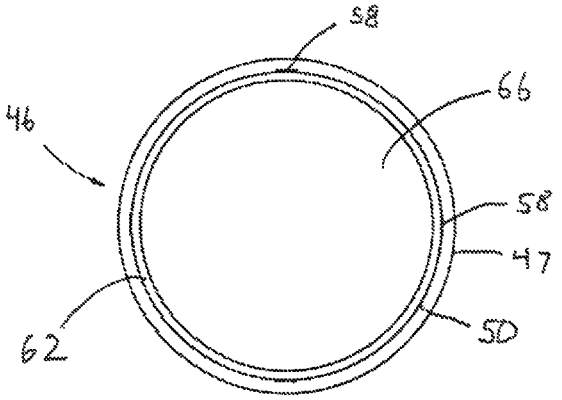
FIG. 15 is a top plan view of the intermediary cover device of FIG. 14.
Figure 16:
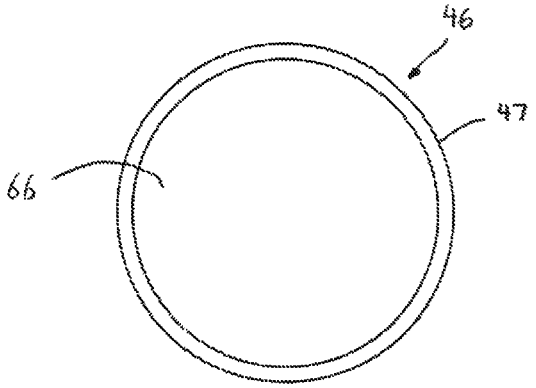
FIG. 16 is a bottom plan view of the intermediary cover device of FIG. 14.
Figure 17:
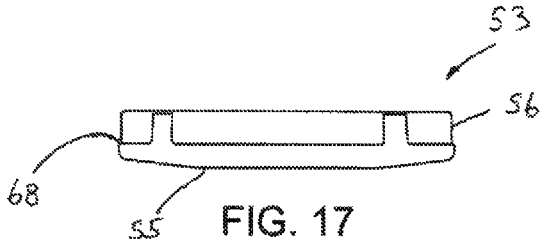
FIG. 17 is a side elevation view of a container cover member of the container apparatus of the collapsible cup assembly of FIG. 1.
Figure 18:
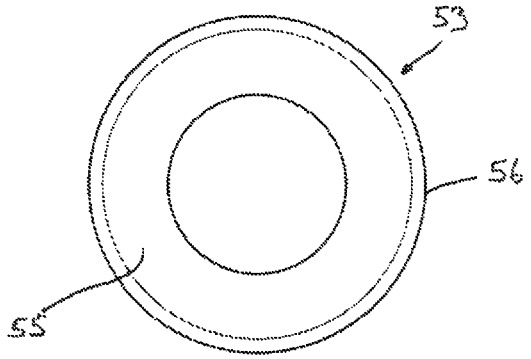
FIG. 18 is a top plan view of the container cover member of FIG. 17.
Figure 19:
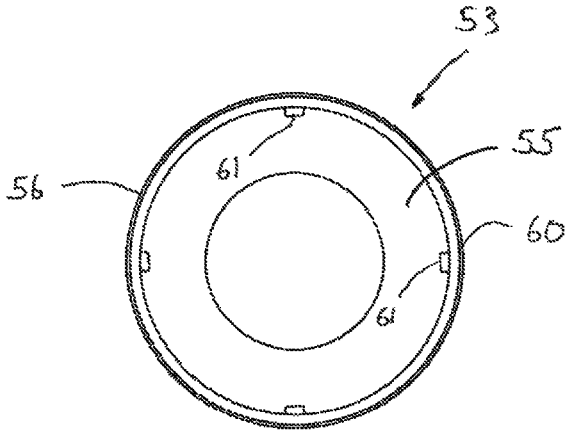
FIG. 19 is a bottom plan view of the container cover member of FIG. 17.

In accordance with the present invention, referring now to FIGS. 3, 4 and 13, the lid member 22 includes a top lid portion 36 and two concentric, downstanding inner and outer annular contact walls 37 and 38. These opposing contact walls 37 and 38 are steeply V-shaped (FIG. 4) concentrically spaced, forming an annular steeply V-shaped receiving groove 40 therebetween. Alternatively, as best shown in FIG. 20, the opposing contact walls 37 and 38 are generally vertical and concentrically spaced, forming more of an annular cylindrical ring-shaped receiving groove 40

Regardless, when the lid member 22 is mounted to the top ring segment 25 of the cup assembly 20, the flexible silicone drinking lip segment 32 thereof is dimensioned for press-fit insertion into the receiving groove 40 until a lower annular distal edge 39 of the outer contact wall 38 seats against the annular shoulder portion 44 of the top ring segment.

At the upper distal edge 41 of the drinking lip segment 32, the opposed contact walls 37 and 38 are spaced and oriented to squeeze and press-fit the lip therebetween. This forms a relatively air-tight seal between the drinking lip segment in the cover receiving groove 40, securely mounting the lid member 22 to the cup apparatus 21. Such mounting security even facilitates axial expansion of the cup assembly 20 when being manually pulled apart in an axial direction from the collapsed position (FIGS. 5-7) toward the expanded position (FIGS. 1-4 and 8). That is, a user can open or axially expand the cup assembly 20 by simply radially gripping the flared bottom flange 31, in one hand, and the outer contact wall 38 of the lid member 22, in the other hand before the lid member separates from the drinking lip segment 32. In most instances, due to the integrity of the press-fit or friction-fit mount, as well as the creation of a slight vacuum formed by the deformed drinking lip segment in the receiving groove, pulling apart the cup apparatus 21 while holding the lid member 22 and the flared flange 31 will not dislodge the drinking lip segment 32 from the annular receive groove 40 until the cup apparatus is fully extended in the expanded position.

As mentioned, the collapsible drinking cup assembly 20 incorporates a relatively rigid mountable lid member 22. This lid member is also preferably light weight, such as being composed of a relatively rigid thermoplastic polymer material such as polypropylene. This rigidity is advantageous in that the cover can be more easily pressed onto the flexible cup drinking lip segment. The rigidity of the lid member also facilitates cooperative sealing with the drinking lip segment. For example, when the lid member is pushed onto or mounted to the cup, the inner contact wall 37 of the lid member causes the silicone rubber drinking lip segment 32 to "press outwardly" against the cup lip and create an appreciable seal therebetween. Such press-fit cooperation holds the lid member 22 in place by friction, and prevents dirt and debris from entering the cup cavity when stored or transported. Other benefits of the cover rigidity include facilitating protection of the cup apparatus 21 from scratches and punctures during storage or transport, as well as allowing the incorporation of the press-fit or snap features (bumps) that permit the divider tray and storage cap to be removably affixed to the cover chamber. Lastly, the thermoplastic polymer composition of the lid member inherently has a lesser coefficient of friction than that of an elastomeric material which aids sliding of the cup assembly 20 into pockets, bags, etc.

Briefly, while the present invention has been described as squeezing the drinking lip segment 32 between both the opposed contact walls 37 and 38, it will be appreciated that the cooperative contact between the rigid lid member 22 and the drinking lip segment 32 may be such that only contact wall 37 is in engagement therewith. Moreover, referring now to FIG. 4, it will be appreciated that the drinking lip segment 32 is relatively thick, especially at the annular shoulder portion 44 of the lower base portion 34. This provides a sufficient degree of axial rigidity that enables press-mount of the lid member thereon.

Figure 22:
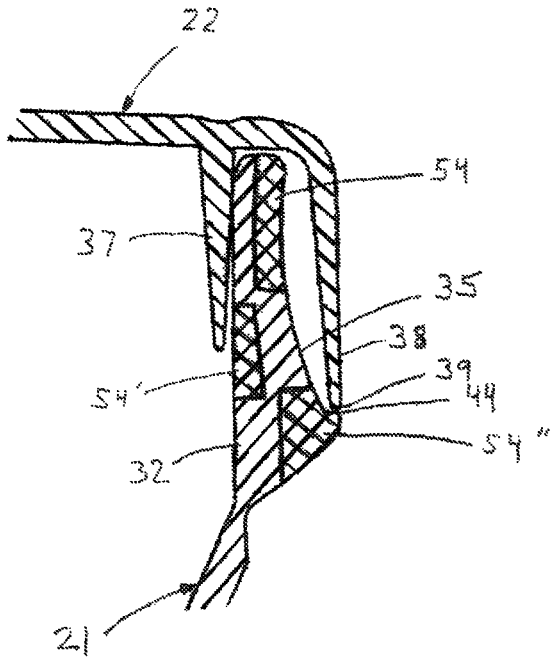
FIG. 22 is an enlarged, side elevation view, in cross-section, of an alternative embodiment lip segment of the cup apparatus of FIG. 4.

Referring now to FIG. 22, it will be appreciated that one or more annular rigid ring components plastic (e.g., ring components 54, 54' 54") that are integrally formed within the drinking lip segment 32 of the cup apparatus 21. These rigid ring components 54, 54', 54" can be metal or plastic, for instance, and would be molded or formed first. The silicone could then be injected against these one or more ring components, bonding to them. The advantage of these rigid rings is that they would provide the lip segment 32 with a more rigid, stable feel at this opening into the cup. In another configuration, these rigid rings could be snap-fit into place after the cup apparatus has been molded, or could be affixed through adhesives, etc.

Figure 2:
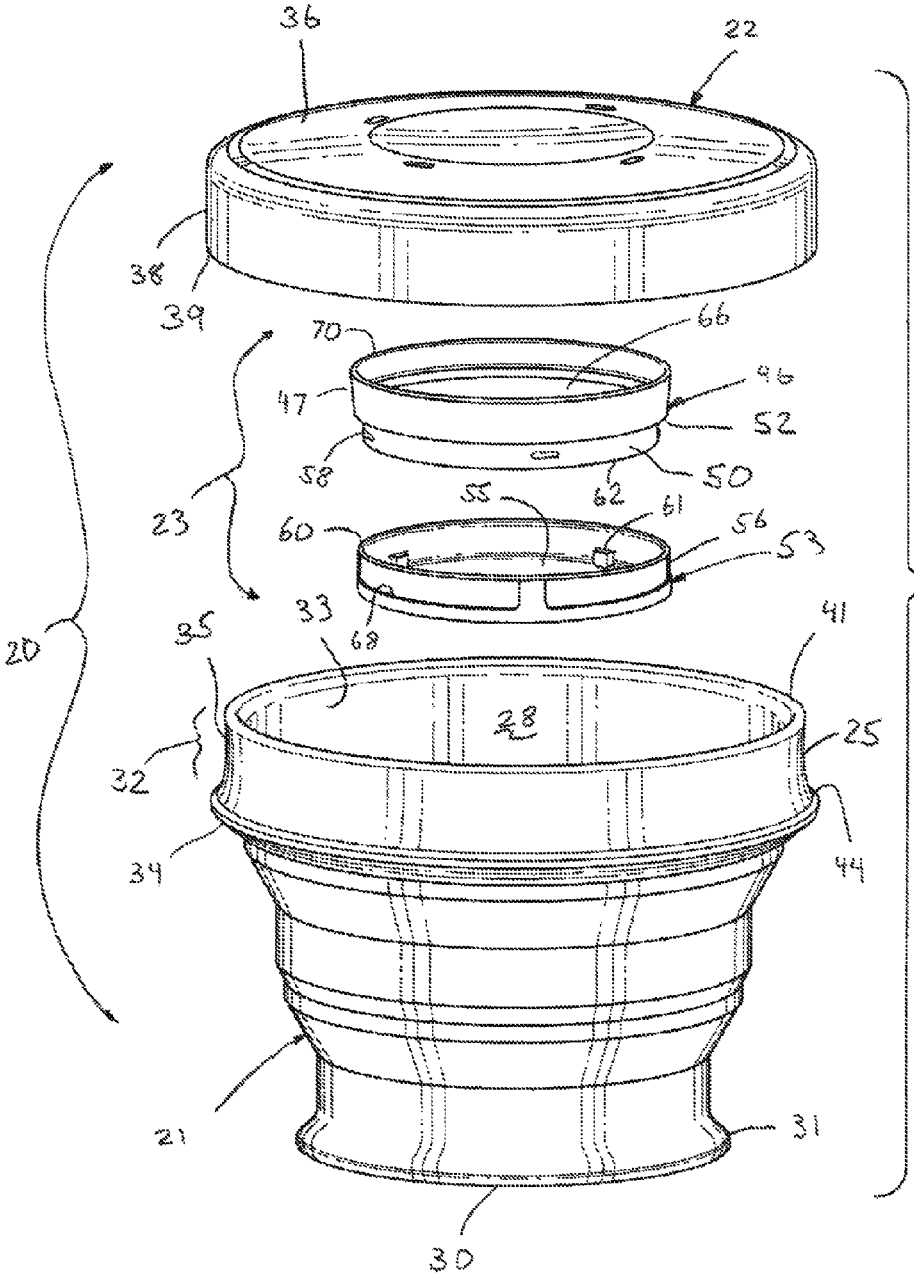
FIG. 2 is an exploded, top perspective view of the collapsible cup assembly of FIG. 1.

Due to this relatively air-tight seal, at least one communication aperture 42 extends through the top lid portion 36 to enable the intake and escape of air from the container cavity 28 during collapse and/or expansion of the cup apparatus which of course increases or decreases the volume capacity to the cup capacity. As illustrated in FIGS. 1 and 2, preferably four apertures 42 may be provided, equally radially spaced from one another. Other numbers or orientations of apertures of course may be provided.

In accordance with the present invention, as mentioned above, the lid member 22 further includes a relatively rigid, integral container apparatus 23 that enables protected storage of small items such as pills, medicine, jewelry, etc. Turning now to FIGS. 2, 4 and 7, the integrated container apparatus 23 is preferably provided by a dual container assembly that defines two separate and independent container compartments 45, 51. Briefly, the container apparatus 23 includes an annular central container wall 43, downstanding from the cover portion 36 of the lid member 22, a relatively rigid intermediary cover device 46 and a relatively rigid container cover member 53. The intermediary cover device 46 is mountable to the central container wall 43 while the container cover member 53 is mountable to the intermediary cover device 46. It will be appreciated, however, as will be described in greater detail below, that the container cover member 53 can also be mounted to the central container wall 43 as well.

Referring now to FIGS. 3 and 4, the central container wall 43 downstands from an underside surface of the top lid portion 36 of the lid member 22, and terminates at a lower distal edge 49. This distal edge 49 defines an opening into the primary container cavity 45. The container wall 43 is also centrally and concentrically positioned within the inner contact wall 37.

Figure 21:
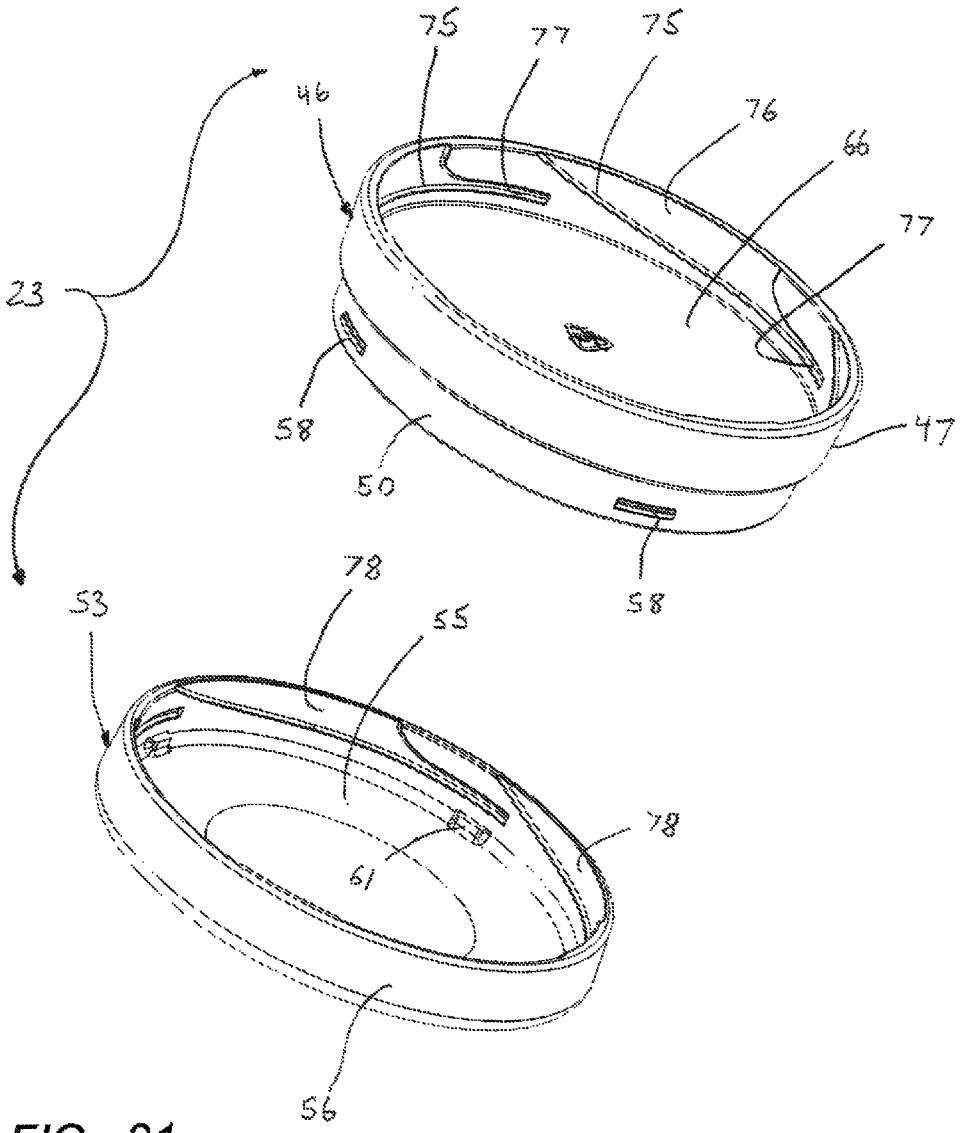
FIG. 21 is an exploded, top perspective view of the container apparatus of the collapsible cup assembly of FIG. 20.

The intermediary cover device 46 includes an intermediary cover portion 66, and an annular upper contact wall 47 upstanding therefrom that is sized and dimensioned to preferably threadably engage the central container wall 43 for mounting engagement therewith. As best illustrated in FIGS. 20 and 21, an intermediary cover device 46 is shown with a "twist-off" design wherein the interior walls of the upstanding upper contact wall 47 define two or more bayonet-style groove regions 75 radially spaced-apart. An upper portion of each groove region 75 includes a relatively wide lead-in capture zone 76 that tapers down to a relatively narrow retaining zone 77.

When the intermediary cover device 46 is threadably mounted to the down standing central container wall 43, the capture zones 76 of the bayonet-style groove regions 75 are formed to capture and slideably receive a retaining nub 65 protruding radially outward from an exterior facing surface of the annular central container wall 43 of the lid member 22. As the upper contact wall 47 of the intermediary cover device 46 is twisted and place about the central container wall 43, the retaining nub 65 will be aligned and received in the respective capture zone 76. Upon further twisting, the retaining nub 65 will be guided into the respective retaining zone 77 of the groove region 75, retaining the intermediary cover device 46 to the lid member 22.

In the embodiment shown in FIGS. 20 and 21, there are four bayonet-style groove regions 75 equally spaced apart radially, and four corresponding retaining nubs 65 that are also equally spaced apart radially. These groove regions 75 and corresponding retaining nubs 65 are formed and dimensioned to engage simultaneously for a secure rotational mount. More or less bayonet-style groove regions and corresponding retaining nubs can be provided. Furthermore, it will be appreciated that the contact wall 47 may include the retaining nubs while the container wall 43 defines the bayonet-style groove regions.

Although the threaded engagement between the intermediary cover device 46 and the lid member 22 is more of a slide and lock type mechanism, other conventional threaded mechanisms can be applied. Moreover, in another specific embodiment, referring back to FIGS. 1-4, the upper contact wall 47 can concentrically slide over and about the central container wall 43, enclosing the primary container cavity 45. This sliding engagement is formed for cooperative snap-fit mounting wherein an interior facing surface of the upper contact wall 47 defines an annular ledge portion 48 inwardly protruding. This is formed to cooperatively contact the one or more retaining nubs 65 radially spaced about an exterior facing surface of the annular central container wall 43 of the lid member 22 to retain the intermediary cover device 46 thereto in a snap-fit manner. It will be appreciated, of course, that contact wall 47 may include the retaining nubs while the container wall 43 defines the annular ledge portion 48.

In general, when the intermediary cover portion 66 is mounted to the central container wall 43, the lower distal edge 49 thereof and the floor of the intermediary cover portion 66 contact one another for a rigid engagement therebetween. Accordingly, this functions as a stop device, limiting the insertion of the contact wall 47 into the intermediate cover device 46. Moreover, it will be understood that the engagement of the lower distal edge 49 of the central container wall 43 with the bottom surface of the intermediary cover portion 66 of the intermediary cover device 46 is cooperatively aligned with the snap-fit engagement between the retaining nubs 65 and the protruding ledge portion of the upper contact wall 47.

On the opposed side of the intermediary cover portion 66 of the intermediary cover device 46, a lower contact wall 50 downstands therefrom, terminating at an annular lower distal edge 62 and forming the second container cavity 51 (FIG. 4). This lower contact wall 50 has an outer facing surface with a diameter substantially similar to that of the central container wall 43 of the lid member 22, albeit having a height that is significantly lower. The diametric difference between the lower contact wall 50 and the upper contact wall 47, hence, define an annular contact shoulder 52 therebetween.

As mentioned, the container apparatus 23 includes the relatively rigid container cover member 53, which in turn includes a container cover portion 55, and a cover contact wall 56 that is sized to preferably threadably engage the lower contact wall 50 of the intermediary device for removably threaded engagement therewith. Similar to the intermediary cover device, the threaded engagement of the container cover member 53 is preferably provided by a slide and lock type mechanism as well. For instance, an interior facing surface of the cover contact wall 56 defines one or more bayonet-style groove regions 78 (four shown in the embodiment of FIGS. 20 and 21) that cooperatively receive and slideably engages a respective retaining nub 58 outstanding from an exterior facing surface of the downstanding lower contact wall 50 of the intermediary cover device. As stated above, the slide and lock mechanism features of the retaining nubs and the bayonet-style groove regions may be reversed as well.

Alternatively, the cover contact wall 56 can concentrically slide over and about the downstanding lower contact wall 50 of the intermediary cover device 46, in a cooperative snap-fit manner. Similar to the intermediary cover device, this sliding engagement of the container cover member 53 is preferably in a cooperative snap-fit manner. The interior facing surface of the cover contact wall 56 defines an annular ledge portion 57, inwardly protruding, that cooperatively snap-fit engages at least one radially spaced retaining nub 58 of the intermediary cover device. Again as stated above, the snap fit features of the retaining nubs and the ledge portions may be reversed as well.

In general, a distal edge 60 of the annular cover contact wall 56 abuts and contacts the contact shoulder 52 of the intermediary cover device 46. However, to further prevent over-insertion, the floor of the container cover member 53 include at least two upstanding, spaced stops devices 61 that are configured for abutting contact with a lower distal edge 62 of the downstanding lower contact wall 50. Accordingly, when the container cover member 53 is mounted to the lower contact wall 50 of the intermediary device, the contact walls are slidably inserted into cover contact walls until the lower distal edge 62 thereof abuts the stop devices 61 of the container cover member 53. Similar to the primary container above, the engagement of the lower distal edge 62 of the lower contact wall 50 with the stop devices 61 of the container cover member 53 is cooperatively aligned with the snap-fit engagement between the retaining nubs 58 of the lower contact wall 50 and the protruding ledge portion 57 of the upstanding cover contact wall 56.

Briefly, while four equally spaced stop devices 61 are preferably provided, it will be appreciated that the stop device be provided by a continuous annular ledge or that the stop device could be excluded altogether, effectively making the stop mechanism be the contact of the distal edge 60 and the contact shoulder 52 without departing from the true spirit and nature of the present invention.

At the outer intersection between the annular cover contact wall 56 and the container cover portion 55 of the container cover member 53, an upward facing annular gripping ledge 68 is formed that enables the user to pry off the container cover member 53, e.g. by catching a finger nail on them. Similarly, with respect to the intermediary cover device 46, the upper distal edge 70 of the upstanding upper contact wall 47 flares radially outward, slightly away from the central container wall 43. This creates a small gap with the wall so that the upper distal edge 70 of the upper contact wall 47 can be dislodged using ones fingertip or finger nail.

Briefly, it will be appreciated that the axial height of the central container wall 43 of the intermediary cover device 46, as well as that of the lower contact wall of the container cover member 53 are such that, on their own, they can function as standalone containers. That is, when they are flipped over, their respective contact walls and cover portions can form their own containers. Furthermore, the size and dimension of the container cover member 53 are such that it can cooperate with the central container wall 43 to enclose the primary container cavity 45 thereof. It will further be appreciated that another benefit of the container apparatus 23 is that the intermediary cover device 46 and the container cover member 53, when flipped over, can function as a stand-alone container that one may place into their pocket.

As shown in FIG. 7, it will further be appreciated that the collective stacked or axial height ($H_1$) of the cover member 53, the intermediary cover device 46 and the lid member 22, when mounted to one another, is generally similar to the interior axial ($H_2$) of the cup apparatus 23, in the collapsed condition. This distance $H_2$ spans between an interior facing surface 72 of the support floor 30 and the upper distal edge 41 of the drinking lip segment 32. Accordingly, it will be appreciated that the definition of "generally similar" means within about ±10% to about ±20% to of one another. Preferably, the axial height $H_2$ of the collapsed collapsible drinking cup assembly 20 is slightly longer than the axial height $H_1$ of collective stacked assembly of the cover member 53.

Since the container apparatus 23 is collectively relatively rigid, together with its' stacked height, when mounting of the lid member 22 to the cup assembly, the axial collapse of the expanded cup apparatus 21 from the operational expanded position (FIGS. 1-4 and 8) and the stored collapsed position (FIGS. 5-7) is actually facilitated. That is, the rigid understructure of the container apparatus 23 (i.e., the cover portion 55 of the cover member 53) provides a stop structure upon which the support floor 30 of the cup apparatus 21 can abut against, preventing inversion of the flexible ring and conical segments, and further folding facilitation at the fold interfaces 27, 27', 27" and 27'" (FIG. 7). Conversely, the bottom of the cup apparatus when abutted against the cover member 53, in the collapsed state, can help to prevent the cover member from being dislodged.

Briefly, the intermediary cover device 46 includes a generous round or fillet at the bottom intersection between the downstanding lower contact wall 50 and the bottom surface of the intermediary cover portion 66. This is design is intended to make it easier to "push out" small pills and objects. That is, the user can push a small pill along the bottom until it hits the side and then the fillet tends to push the object up where it can be slightly easier to grab.

The interior base of the cup apparatus 21 features a generous round/fillet portion at the corner intersection between the cup support floor 30 and the upstanding ring segment 25". This is to assist with cleaning i.e. easier to wipe the cup and harder for mildew to collect there.

Finally, while both the intermediary cover device 46 and the container cover member 53 are primarily shown in the figures as being mountable by snap-fit means, it will be appreciated that conventional threaded mounting designs are preferred. It will further be appreciated that other conventional interference-fit forms can be implemented as well, or any combination thereof.

Although the present invention has been described in connection with the preferred form of practicing it and modifications thereto, those of ordinary skill in the art will understand that many other modifications can be made thereto within the scope of the claims that follow. Accordingly, it is not intended that the scope of the invention in any way be limited by the above description, but instead be determined entirely by reference to the claims that follow.

What is claimed is:

1. A collapsible drinking cup assembly comprising:

a flexible cup apparatus manually movable between a collapsed position and an expanded position, said cup apparatus including:

a plurality of annular ring segments each flexibly coupled together, end-to-end, at a flexible, annular fold interface, and sequentially sized and dimensioned such that each respective adjacent lower ring segment is concentrically nested within each respective adjacent upper ring segment, when in the collapsed position, said plurality of annular ring segments includes an upper drinking lip segment having an interior sidewall and an exterior sidewall such that the drinking lip segment tapers inwardly from a lower base portion to an annular upper distal edge thereof, at least one of said interior sidewall and said exterior side wall of said drinking lip segment being concave, and a support floor extending over a bottom portion of a bottom ring segment of said plurality of annular ring segments, said support floor having an annular bottom flange extending radially beyond an exterior wall of said bottom ring segment; and a relatively rigid top lid member having a top lid portion formed and dimensioned to extend over an opening into said cup apparatus defined by said upper distal edge of said drinking lip segment, said top lid member having a pair of opposed, inner and outer contact walls downstanding from said top lid portion that collectively define an annular receiving groove therebetween formed and dimensioned for friction-fit receipt of the drinking lip segment therein, said lower base portion of said drinking lip segment includes an upward facing annular shoulder portion formed and dimensioned to seat against a lower annular edge of said exterior contact wall of said top lid member when said drinking lip segment is fully received within said receiving groove, forming an air-tight seal such that said cup apparatus can be expanded from the collapsed position to the expanded position when both the annular bottom flange and the lid member are radially gripped and axially pulled apart longitudinally thereof before separation of the lid member from the drinking lip segment.

2. The collapsible drinking cup assembly according to claim 1, wherein said exterior sidewall of said drinking lip segment is concave.

3. The collapsible drinking cup assembly according to claim 1, wherein said cup apparatus is comprised of silicone rubber.

4. The collapsible drinking cup assembly according to claim 1, wherein said top lid member defines one or more communication apertures extending therethrough.

5. The collapsible drinking cup assembly according to claim 1, wherein said annular ring segments include alternating cylindrical ring segments and conical ring segments when oriented in the expanded position.

6. The collapsible drinking cup assembly according to claim 1, wherein said top lid member includes an annular, central container wall downwardly depending from said top lid portion, defining a primary container cavity; and said cup assembly further including:

a relatively rigid container cover member having a container cover portion formed and dimensioned to extend over an opening into said primary container cavity, defined by a lower distal edge of said central container wall, said container cover member further includes an annular cover contact wall upstanding from said container cover portion, and formed and dimensioned to cooperate with said central container wall for mounting thereto.

7. The collapsible drinking cup assembly according to claim 6, wherein one of an outer facing surface of said central container wall and an inner facing surface of the cover contact wall defines an annular ledge portion, and the other of said inner facing surface of the cover contact wall and the outer facing surface of said central container wall defines at least one retaining nub formed and dimensioned to cooperate with said annular ledge portion for friction-fit engagement therebetween.

8. The collapsible drinking cup assembly according to claim 6, further including:

a relatively rigid intermediary cover device having an intermediary cover portion formed and dimensioned to extend over said opening into said primary container cavity, said intermediary cover device having an annular upper contact wall upstanding from said intermediary cover portion and being formed and dimensioned for friction-fit association with said central container wall for mounting of said intermediary cover device thereto, and said intermediary cover device further including an annular lower contact wall downwardly depending from said intermediary cover portion and defining a secondary container cavity therein, said lower contact wall being formed and dimensioned for friction-fit association with the annular cover contact wall of said container cover portion for mounting thereto, enclosing the secondary container cavity.

9. The collapsible drinking cup assembly according to claim 8, wherein one of an outer facing surface of said central container wall and an inner facing surface of the upper contact wall of the intermediary cover device defines an annular upper ledge portion, and the other of said inner facing surface of the upper contact wall of the intermediary cover device and the outer facing surface of said central container wall defines at least one upper retaining nub formed and dimensioned to cooperate with said annular upper ledge portion for friction-fit engagement therebetween, and one of an outer facing surface of said annular lower contact wall of said intermediary cover device and central container wall and an inner facing surface of the cover contact wall defines an annular lower ledge portion, and the other of said inner facing surface of the cover contact wall and the outer facing surface of said lower contact wall of said intermediary cover device defines at least one lower retaining nub formed and dimensioned to cooperate with said lower ledge portion for friction-fit engagement therebetween.

10. A collapsible drinking cup assembly comprising:

a flexible cup apparatus manually movable along a longitudinal axis thereof between a collapsed position and an expanded position, said cup apparatus including:

a plurality of annular ring segments each flexibly coupled together, end-to-end, at a flexible, annular fold interface, and sequentially sized and dimensioned such that each respective adjacent lower ring segment is concentrically nested within each respective adjacent upper ring segment, when in the collapsed position, said plurality of annular ring segments includes an upper drinking lip segment and a bottom ring segment, said upper drinking lip segment having an annular upper distal edge thereof defining an opening into the cup apparatus, and an interior sidewall and an exterior sidewall such that the drinking lip segment tapers inwardly from a lower base portion thereof to said upper distal edge thereof, at least one of said interior sidewall and said exterior side wall of said drinking lip segment being concave, and said bottom ring segment having a support floor extending over a bottom portion of a bottom ring segment, wherein in said collapsed position, said cup apparatus having a collapsed height, along said longitudinal axis thereof, extending from said upper distal edge to an interior bottom surface of said support floor;

a relatively rigid top lid member having a top lid portion formed and dimensioned to extend over said opening into said cup apparatus when removably mounted to said cup apparatus in a closed condition, said top lid member having a pair of opposed, inner and outer contact walls down standing from said top lid portion that collectively define an annular receiving groove therebetween formed and dimensioned for friction-fit receipt of the drinking lip segment therein, forming an air-tight seal, said top lid member further includes an annular, central container wall downwardly depending from said top lid portion, defining a primary container cavity; and a relatively rigid container cover member having a container cover portion formed and dimensioned to extend over an opening into said primary container cavity, defined by a lower distal edge of said central container wall, said container cover further includes an annular cover contact wall upstanding from said container cover portion, and formed and dimensioned to cooperate association with said central container wall for mounting thereto;

said top lid member and said container cover member being formed and dimensioned such that when said container cover member is removably mounted to said top lid member, a longitudinal cover height extending from a top surface of the top lid member to a bottom surface of said container cover member is generally the same as said collapsed height of the cup apparatus, in said collapsed condition, when said cup apparatus and said top lid member are in the closed condition; and said lower base portion of said drinking lip segment includes an upward facing annular shoulder portion formed and dimensioned to seat against a lower annular edge of said exterior contact wall of said top lid member when said drinking lip segment is fully received within said receiving groove, forming said air-tight seal.

11. The collapsible drinking cup assembly according to claim 10, wherein said top lid member defines one or more communication apertures extending therethrough.

12. The collapsible drinking cup assembly according to claim 10, wherein one of an outer facing surface of said central container wall and an inner facing surface of the cover contact wall defines an annular ledge portion, and the other of said inner facing surface of the cover contact wall and the outer facing surface of said central container wall defines at least one retaining nub formed and dimensioned to cooperate with said annular ledge portion for friction-fit engagement therebetween.

13. The collapsible drinking cup assembly according to claim 10, wherein said exterior sidewall of said drinking lip segment is concave.

14. A collapsible drinking cup assembly comprising:

a flexible cup apparatus manually movable along a longitudinal axis thereof between a collapsed position and an expanded position, said cup apparatus including:

a plurality of annular ring segments each flexibly coupled together, end-to-end, at a flexible, annular fold interface, and sequentially sized and dimensioned such that each respective adjacent lower ring segment is concentrically nested within each respective adjacent upper ring segment, when in the collapsed position, said plurality of annular drinking lip ring segments includes an upper drinking lip segment and a bottom ring segment, said upper ring drinking lip segment having an annular upper distal edge thereof defining an opening into the cup apparatus, and an interior sidewall and an exterior sidewall such that the drinking lip segment tapers inwardly from a lower base portion thereof to said upper distal edge thereof, at least one of said interior sidewall and said exterior side wall of said drinking lip segment being concave, and said bottom ring segment having a support floor extending over a bottom portion of a bottom ring segment, wherein in said collapsed position, said cup apparatus having a collapsed height, along said longitudinal axis thereof, extending from said upper distal edge to an interior bottom surface of said support floor;

a relatively rigid top lid member having a top lid portion formed and dimensioned to extend over said opening into said cup apparatus when removably mounted to said cup apparatus in a closed condition, said top lid member having a pair of opposed, inner and outer contact walls down standing from said top lid portion that collectively define an annular receiving groove therebetween formed and dimensioned for friction-fit receipt of the drinking lip segment therein, forming an air-tight seal, said top lid member further includes an annular, central container wall downwardly depending from said top lid portion, defining a primary container cavity;

a relatively rigid intermediary cover device having an intermediary cover portion formed and dimensioned to extend over an opening into said primary container cavity, defined by a lower distal edge of said central container wall, said intermediary cover device having an annular upper contact wall upstanding from said intermediary cover portion and being formed and dimensioned for friction-fit association with said central container wall for mounting of said intermediary cover device thereto, said intermediary cover device further including an annular lower contact wall downwardly depending from said intermediary cover portion and defining an opening into a secondary container cavity therein;

a relatively rigid container cover member having a container cover portion formed and dimensioned to extend over said opening into said secondary container cavity, said container cover further includes an annular cover contact wall upstanding from said container cover portion, and formed and dimensioned to cooperate with said lower contact wall for mounting thereto;

said top lid member, said intermediary cover device, and said container cover member being formed and dimensioned such that when said intermediary cover device is removably mounted to said top lid member, and said container cover member is removably mounted to said intermediary cover device, a collective longitudinal cover height extending from a top surface of the top lid member to an exterior bottom surface of said container cover member is generally the same as said collapsed height of the cup apparatus, in said collapsed condition, when said cup apparatus and said top lid member are in the closed condition and;

said lower base portion of said drinking lip segment includes an upward facing annular shoulder portion formed and dimensioned to seat against a lower annular edge of said exterior contact wall of said top lid member when said drinking lip segment is fully received within said receiving groove, forming said air-tight seal.

15. The collapsible drinking cup assembly according to claim 14, wherein one of an outer facing surface of said central container wall and an inner facing surface of the upper contact wall of the intermediary cover device defines an annular upper ledge portion, and the other of said inner facing surface of the upper contact wall of the intermediary cover device and the outer facing surface of said central container wall defines at least one upper retaining nub formed and dimensioned to cooperate with said annular upper ledge portion for friction-fit engagement therebetween, and one of an outer facing surface of said annular lower contact wall of said intermediary cover device and central container wall and an inner facing surface of the cover contact wall defines an annular lower ledge portion, and the other of said inner facing surface of the cover contact wall and the outer facing surface of said lower contact wall of said intermediary cover device defines at least one lower retaining nub formed and dimensioned to cooperate with said lower ledge portion for friction-fit engagement therebetween.

* * * * *